US011443679B1

(12) United States Patent
Lai et al.

(10) Patent No.: US 11,443,679 B1
(45) Date of Patent: Sep. 13, 2022

(54) DISPLAY DEVICE AND DISPLAY METHOD

(71) Applicant: Au Optronics Corporation, Hsinchu (TW)

(72) Inventors: Pei-Fen Lai, Hsinchu (TW); Hung-Chi Wang, Hsinchu (TW); Ya-Fang Chen, Hsinchu (TW); Chih-Hsiang Yang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/401,289

(22) Filed: Aug. 12, 2021

(30) Foreign Application Priority Data

Mar. 5, 2021 (TW) ..... 110107874

(51) Int. Cl.
*G09G 3/20* (2006.01)
*G09G 5/10* (2006.01)

(52) U.S. Cl.
CPC ..... *G09G 3/2003* (2013.01); *G09G 5/10* (2013.01); *G09G 2320/0242* (2013.01); *G09G 2320/045* (2013.01); *G09G 2360/141* (2013.01); *G09G 2360/147* (2013.01); *G09G 2360/16* (2013.01)

(58) Field of Classification Search
CPC ..... G09G 3/2003; G09G 5/10; G09G 2320/0242; G09G 2320/045; G09G 2360/141; G09G 2360/147; G09G 2360/16
See application file for complete search history.

(56) References Cited

U.S. PATENT DOCUMENTS

| | | | | |
|---|---|---|---|---|
| 7,671,542 | B2 * | 3/2010 | Chang | H05B 45/22 315/246 |
| 7,696,964 | B2 | 4/2010 | Lankhorst et al. | |
| 8,022,923 | B2 * | 9/2011 | Yang | H05B 45/10 345/82 |
| 8,264,453 | B2 | 9/2012 | Yang et al. | |
| 9,477,105 | B2 * | 10/2016 | Hwang | G02F 1/13306 |
| 10,964,262 | B1 * | 3/2021 | Lin | G09G 3/2022 |
| 2007/0285378 | A1 * | 12/2007 | Lankhorst | G09G 3/342 345/102 |
| 2009/0001894 | A1 * | 1/2009 | Hsu | G01J 1/32 250/206 |
| 2009/0085859 | A1 * | 4/2009 | Song | G09G 3/3406 349/61 |
| 2009/0108768 | A1 * | 4/2009 | Yang | H05B 45/325 315/291 |
| 2010/0141154 | A1 | 6/2010 | Wang et al. | |
| 2013/0057592 | A1 * | 3/2013 | Tseng | G09G 5/026 345/690 |

(Continued)

FOREIGN PATENT DOCUMENTS

| | | |
|---|---|---|
| TW | 200809721 | 2/2008 |
| TW | 201226864 | 7/2012 |

*Primary Examiner* — Kenneth Bukowski
(74) *Attorney, Agent, or Firm* — JCIPRNET

(57) ABSTRACT

A display device and a display method are provided. The display device includes a board, a sensing circuit, and a feedback control circuit. The board includes a display array formed by a plurality of pixels. The sensing circuit includes a test pixel and a light sensor. The light sensor receives light emitted by the test pixel to generate a corresponding sensing signal. The feedback control circuit receives the sensing signal and generates a pulse width adjusting signal to adjust a pulse width at which the pixels are operated for display.

8 Claims, 5 Drawing Sheets

(56) References Cited

U.S. PATENT DOCUMENTS

2016/0027378 A1* 1/2016 Kim ..... G09G 3/3233
345/207
2019/0371231 A1* 12/2019 Kim ..... G09G 3/2081

* cited by examiner

DISPLAY DEVICE AND DISPLAY METHOD

CROSS-REFERENCE TO RELATED APPLICATION

This application claims the priority benefit of Taiwan application serial no. 110107874, filed on Mar. 5, 2021. The entirety of the above-mentioned patent application is hereby incorporated by reference herein and made a part of this specification.

BACKGROUND

Technical Field

The disclosure relates to an electronic device and a method, and particularly to a display device and a display method.

Description of Related Art

In the existing display technology, pixels configured for display generally have color decay due to the use duration and the operating temperature. Among pixels of different colors, different degrees of color decay occur at different display durations or different operating temperatures. Such differentiated color decay has caused difficulties in aging compensation in the related art.

SUMMARY

The disclosure provides a display device and a display method capable of performing compensation for different display conditions.

A display device according to an embodiment of the disclosure includes a board, a sensing circuit, and a feedback control circuit. The board includes a display array formed by a plurality of pixels. The sensing circuit includes a test pixel and a light sensor. The light sensor receives light emitted by the test pixel to generate a corresponding sensing signal. The feedback control circuit receives the sensing signal and generates a pulse width adjusting signal to adjust a pulse width at which the pixels are operated for display.

A display method according to an embodiment of the disclosure includes the following steps. A display array formed by a plurality of pixels is provided to perform display. A sensing circuit is provided, and a light sensor of the sensing circuit receives light emitted by a test pixel of the sensing circuit to generate a corresponding sensing signal. A feedback control circuit receives the sensing signal and generates a pulse width adjusting signal to adjust a pulse width at which the pixels are operated for display.

Based on the above, the display device and the display method of the disclosure may acquire a sensing signal of the same or similar display conditions through the sensing circuit, and accordingly adjust the pulse width at which the pixels are operated for display, which can effectively improve the color decay.

To make the aforementioned more comprehensible, several embodiments accompanied with drawings are described in detail as follows.

DESCRIPTION OF THE EMBODIMENTS

Figure 1A:
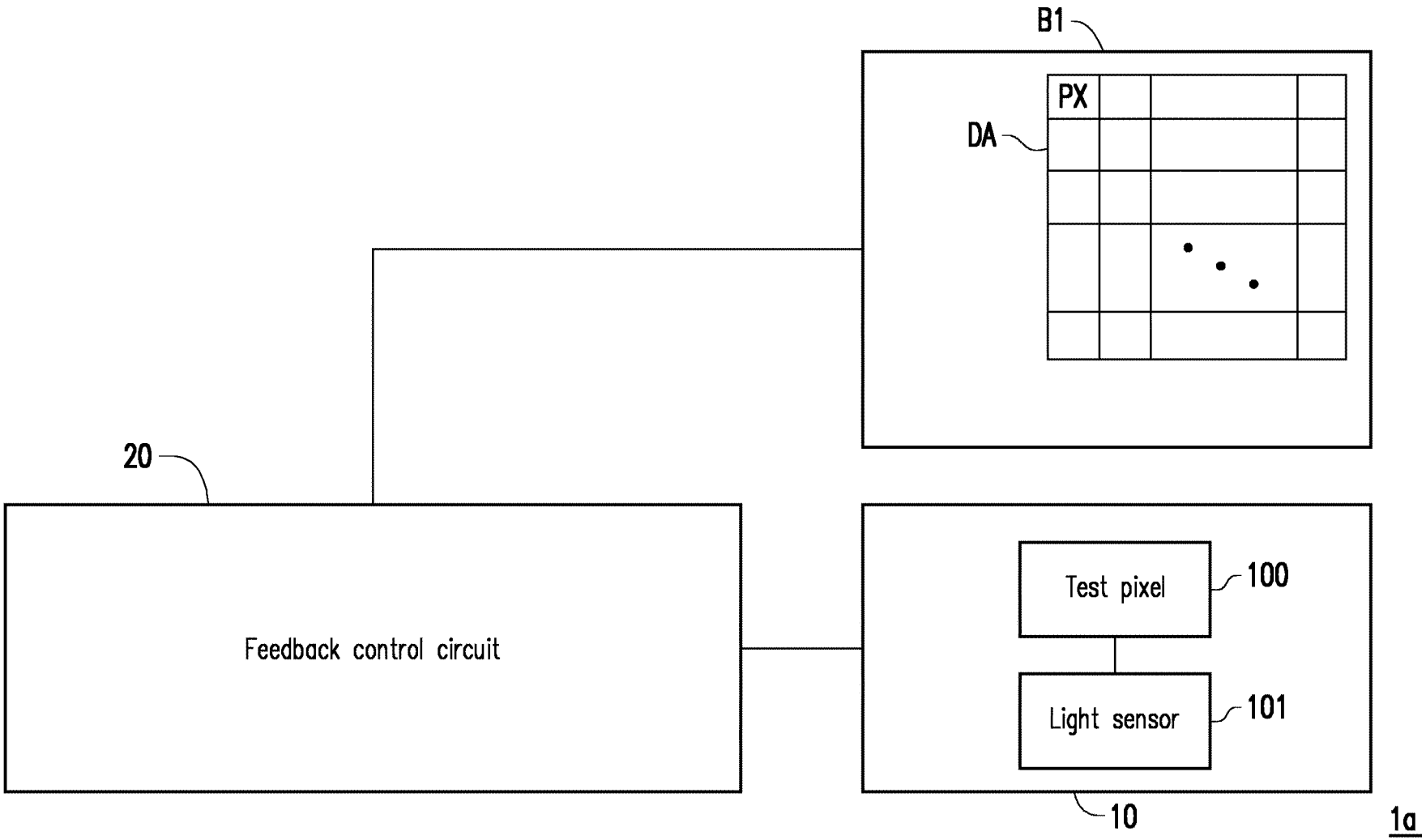
FIG. 1A is a schematic view of a display device according to an embodiment of the disclosure.

FIG. 1A is a schematic view of a display device 1*a* according to an embodiment of the disclosure. The display device 1*a* includes a board B1, a sensing circuit 10, and a feedback control circuit 20. The board B1 includes a display array DA formed by a plurality of pixels PX, and the board B1 may display an image through the display array DA. The sensing circuit 10 includes a test pixel 100 and a light sensor 101. The test pixel 100 may emit light. The light sensor 101 is disposed relative to the position of the test pixel 100, and the light sensor 101 may receive the light emitted by the test pixel 100 to generate a corresponding sensing signal. The feedback control circuit 20 may receive the sensing signal provided by the sensing circuit 10 and determine and generate a pulse width adjusting signal accordingly to thereby adjust a pulse width at which the pixels PX of the display array DA in the display device 1*a* are operated for display.

In an embodiment, the test pixel 100 may be disposed adjacent to the display array DA, so the test pixel 100 may have similar display conditions as the pixels PX in the display array DA (e.g., emitting light at the same or similar temperature, or having the same or similar aging time). Therefore, the light sensor 101 may sense the brightness of the light emitted by the test pixel 100 and provide a corresponding sensing signal accordingly to the feedback control circuit 20. According to the sensing signal provided by the sensing circuit 10, the feedback control circuit 20 can effectively determine a degree of color decay occurring when the test pixel 100 emits light under the current display condition, and can generate a corresponding pulse width adjusting signal accordingly to adjust the pulse width at which the pixels PX in the display array DA are operated for display. Accordingly, the display device 1*a* can effectively determine the color decay of the pixels PX in the display array DA under the current display condition through the sensing circuit 10, and can adjust the pulse width at which the pixels PX are operated for display through the feedback control circuit 20 to perform compensation, so that the display device 1*a* can effectively overcome the color decay occurring under different display conditions, and the image quality displayed by the display device 1*a* can be effectively improved.

Specifically, the board B1 includes a display array DA that is formed by pixels PX and may receive a driving signal to display an image. The pixel PX may be, for example, a liquid crystal or light-emitting diode (LED). The light-emitting diode may include, for example, an organic light-emitting diode (OLED), a mini LED, a micro LED, a quantum dot (QD) LED (QLED; QDLED), a fluorescence, a phosphor, other suitable materials, or a combination of the above.

Although not shown in FIG. 1A, each of the pixels PX of the display array DA are coupled to a corresponding scan line and a corresponding data line. A scanning circuit is coupled to the scan line, and a driving circuit is coupled to the data line. The driving circuit is configured to provide display data to the data line, and the scanning circuit is configured to control operations of the pixel PX to obtain display data from the data line. Therefore, the display array DA is controlled by the scanning circuit and the driving circuit for display. In some embodiments, both of the scanning circuit and the driving circuit are disposed on the board B1. In some embodiments, the driving circuit may be integrated with the feedback control circuit 20.

The sensing circuit 10 includes a test pixel 100 and a light sensor 101. The test pixel 100 may be disposed adjacent to the pixels in the display array DA. The light sensor 101 is disposed corresponding to a configuration position of the test pixel 100. The light sensor 101 may receive the light emitted by the test pixel 100 and generate a corresponding sensing signal according to the brightness of the received light. In an embodiment, the test pixel 100 may have the same or similar structure or implementation as the pixel PX in the display array DA, and since the test pixel 100 may be disposed adjacent to the display array DA, the test pixel 100 may have the same or similar display conditions as the pixels PX in the display array DA. The sensing circuit 10 senses the brightness of the light emitted by the test pixel 100 to determine the color decay of the pixel PX in the display array DA under the current display condition.

Although not shown in FIG. 1A, the test pixel 100 may have one or more pixel structures. In an embodiment, the test pixel 100 may be a pixel of one single color, and the light sensor 101 may generate a sensing signal by sensing the single-color test pixel 100. In an embodiment, the test pixel 100 may be pixels of multiple colors, and the light sensor 101 may sense the brightness of lights of different colors emitted by the test pixel 100 and generate multiple corresponding sensing signals. Accordingly, when the pixels of multiple colors have different color decays under the same display condition, the light sensor 101 may correspondingly generate sensing signals of the different color decays.

Further, the feedback control circuit 20 may receive the sensing signal provided by the sensing circuit 10. The feedback control circuit 20 may determine the brightness of the light emitted by the test pixel 100 according to the sensing signal to determine whether the test pixel 100 has color decay, and generate a pulse width adjusting signal to adjust the pulse width at which the pixels PX in the display array DA are operated for display.

Accordingly, through the collective configuration of the board B1, the sensing circuit 10, and the feedback control circuit 20, the display device 1*a* can determine the color decay of the pixels PX in the display array DA displaying under the current display condition to further compensate the pulse width at which the pixels PX are operated for display. As a result, the display device 1*a* can effectively overcome the color decay occurring under different display conditions, or the display device 1*a* can overcome differentiated color decays occurring among the pixels PX of different colors under the same display conditions, which can effectively improve the image quality displayed by the display device 1*a*.

Figure 1B:
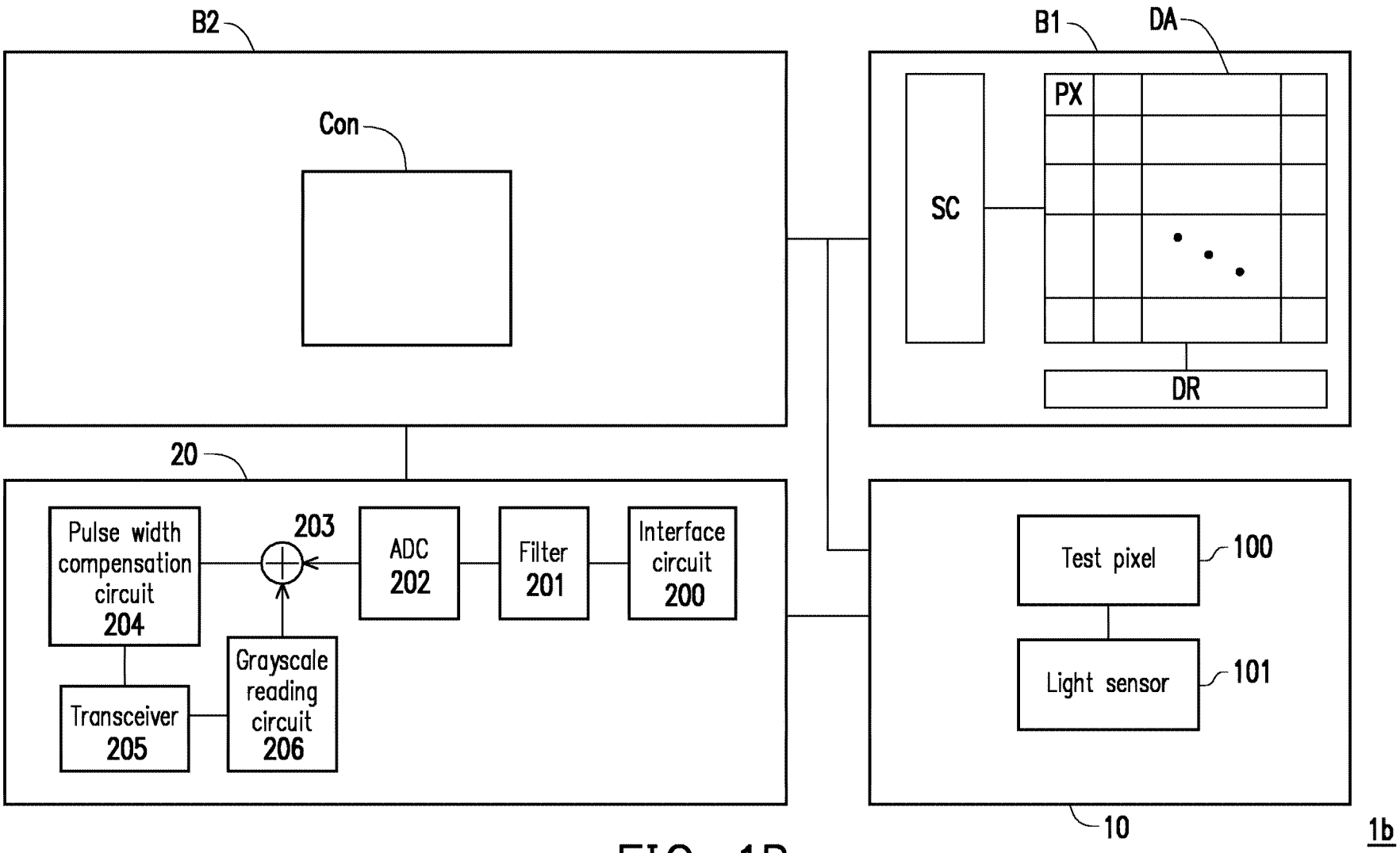
FIG. 1B is a schematic view of a display device according to an embodiment of the disclosure.

FIG. 1B is a schematic view of a display device 1*b* according to an embodiment of the disclosure. The display device 1*b* includes boards B1 and B2, a sensing circuit 10, and a feedback control circuit 20. The board B1 includes a scanning circuit SC, a driving circuit DR, and a display array DA formed by a plurality of pixels PX. The board B2 is coupled to the board B1, and the board B2 includes a controller Con. The controller Con may control the scanning circuit SC and the driving circuit DR in the board B1 to drive the display array DA to display an image. The sensing circuit 10 includes a test pixel 100 and a light sensor 101. The test pixel 100 may be disposed adjacent to the display array DA, and the test pixel 100 may emit light. The light sensor 101 is disposed relative to the position of the test pixel 100, and the light sensor 101 may receive the light emitted by the test pixel 100 to generate a corresponding sensing signal. The feedback control circuit 20 may receive the sensing signal provided by the sensing circuit 10 and determine and generate a pulse width adjusting signal accordingly to adjust the pulse width at which the pixels PX of the display array DA in the display device 1*b* are operated for display.

A display array DA formed by a plurality of pixels PX is provided in the board B1, and the pixels PX may be controlled by the scanning circuit SC and the driving circuit DR to display an image.

A controller Con is provided in the board B2. The board B2 is coupled to the board B1 and may provide appropriate scanning and driving signals to the scanning circuit SC and the driving circuit DR to control the display array DA to display an image.

Although not shown in FIG. 1A, each of the pixels PX of the display array DA are coupled to a corresponding scan line and a corresponding data line. The scanning circuit SC is coupled to the scan line, and the driving circuit DR is coupled to the data line. The driving circuit DR is configured to provide display data to the data line, and the scanning circuit SC is configured to control operations of the pixel PX to obtain display data from the data line. Therefore, the display array DA is controlled by the scanning circuit and the driving circuit for display.

The controller Con may be, for example, a central processing unit (CPU), another programmable general-purpose or specific-purpose micro control unit (MCU), microprocessor, digital signal processor (DSP), programmable controller, application specific integrated circuit (ASIC), graphics processing unit (GPU), arithmetic logic unit (ALU), complex programmable logic device (CPLD), field programmable gate array (FPGA), any other type of integrated circuit, state machine, processor based on Advanced RISC Machine (ARM), another similar device, or a combination of the above devices, as long as the controller Con can receive an image signal and generate appropriate scanning and control signals to the board B1 to cause the display array DA to display a corresponding image.

The test pixel 100 in the sensing circuit 10 may be disposed adjacent to the display array DA, so that the test pixel 100 has the same or similar display conditions as the pixels PX of the display array DA. The light sensor 101 may sense the brightness of the light emitted by the test pixel 100 and generate a corresponding sensing signal.

In this embodiment, the sensing circuit 10 is coupled to the board B2, and the sensing circuit 10 may receive the control of the controller Con in the board B2. In an embodiment, the test pixel 100 in the sensing circuit 10 may receive the control of the controller Con to emit light according to control signals of different grayscale values, and the light sensor 101 provides corresponding sensing signals. In an embodiment, the controller Con may provide a control signal to control the pixels of multiple colors in the test pixel 100 to emit light in respective time intervals. Therefore, the light sensor 101 can correspondingly sense the brightness of lights of different colors and generate corresponding sensing signals.

In addition, the sensing circuit 10 is provided at any position in the display device 1*b*. In an embodiment, the sensing circuit 10 is disposed adjacent to the display array DA, so that the test pixel 100 in the sensing circuit 10 can have display conditions similar to those of the pixels PX in the display array DA. Of course, those with ordinary skill in the art may change or modify the configuration positions of the test pixel 100 and the light sensor 101 in the sensing circuit 10 according to different system requirements or design concepts. In an embodiment, the entire sensing circuit 10 may be disposed on the board B1. For example, the entire sensing circuit 10 may be disposed on the board B1, on the same surface as the display array DA. Alternatively, the entire sensing circuit 10 may be disposed on the board B1, on the surface opposite to the display array DA. In an embodiment, the sensing circuit 10 may be disposed on the board B2. In other words, since the sensing circuit 10 of the display device 1*b* does not sense the display array DA which performs display, the sensing circuit 10 may be selectively disposed outside the active area and the sensing circuit 10 may sense the color decay of the pixels PX without affecting or covering the active area configured for display, which can effectively improve the display quality and reduce the design complexity.

The feedback control circuit 20 includes an interface circuit 200, a filter 201, an analog-to-digital converter (ADC) 202, an arithmetic circuit 203, a pulse width compensation circuit 204, a transceiver 205, and a grayscale reading circuit 206. The interface circuit 200 is coupled to the light sensor 101 of the sensing circuit 10, and the interface circuit 200 may receive a sensing signal. The filter 201 is coupled to the interface circuit 200, and the filter 201 may filter out noise in the sensing signal. The analog-to-digital converter 202 is coupled to the filter 201, and the analog-to-digital converter 202 may convert the filtered sensing signal into a digital signal and provide the digital sensing signal to the arithmetic circuit 203. On the other hand, the control signal provided by the controller Con in the board B2 to the test pixel 100 may also be provided to the transceiver 205 of the feedback control circuit 20 and received by the grayscale reading circuit 206. Specifically, according to the control signal provided by the controller Con, the grayscale reading circuit 206 may determine a predetermined brightness that the test pixel 100 is controlled to display or a color currently displayed by the test pixel 100. Accordingly, the grayscale reading circuit 206 can determine a reference grayscale value to be displayed by the test pixel 100 according to the control signal and provide the reference grayscale value to the arithmetic circuit 203.

In another embodiment, although not shown in FIG. 1B, the feedback control circuit 20 may also sense a driving current configured to drive the display array DA through the interface circuit 200, convert the driving current into a digital signal through the operations of the filter 201 and the analog-to-digital converter 202, and provide the digital signal to the arithmetic circuit 203, so that the arithmetic circuit 203 may further determine a degree of color decay of the pixel PX according to the driving current.

Therefore, the arithmetic circuit 203 may receive the sensing signal provided by the analog-to-digital converter 202, the reference grayscale value provided by the grayscale reading circuit 206, and/or information associated with the driving current of the display array DA. The arithmetic circuit 203 may determine a brightness decay value of the test pixel 100 according to the sensing signal, the reference grayscale value, and/or the driving current of the display array DA. The pulse width compensation circuit 204 is coupled to the arithmetic circuit 203, and according to the brightness decay value provided by the arithmetic circuit 203, the pulse width compensation circuit 204 may calculate how to adjust the pulse width at which the pixels PX in the display array DA are operated for display under the current display condition.

The transceiver 205 is coupled to the pulse width compensation circuit 204, and the transceiver 205 may provide a pulse width adjusting signal calculated and generated by the pulse width compensation circuit 204 to the controller Con of the board B2 to adjust the pulse width at which the pixels PX are operated for display. In an embodiment, the controller Con may make the same adjustment to the pulse width at which all the pixels PX are operated for display according to the pulse width adjusting signal. In an embodiment, a conversion matrix may be stored in the controller Con, and the controller Con may make adaptive adjustments to the pulse width at which each pixel PX is operated for display according to both the pulse width adjusting signal and the conversion matrix. For example, the conversion matrix may store aging information associated with each pixel, so that the controller Con may correspondingly adjust the pulse width for display according to the different aging information of each pixel. Alternatively, the conversion matrix may store position and temperature distribution information associated with each pixel PX in the display array DA, so that after receiving the pulse width adjusting signal generated in response to the color decay of the test pixel 100 at the current temperature, the controller Con may adaptively adjust the pulse width for display according to the different temperature distribution information of each pixel PX. Therefore, the controller Con may make adaptive adjustments for each pixel PX according to the pulse width adjusting signal and the conversion matrix, which can effectively improve the display quality of the display device 1*b*.

Figure 2:
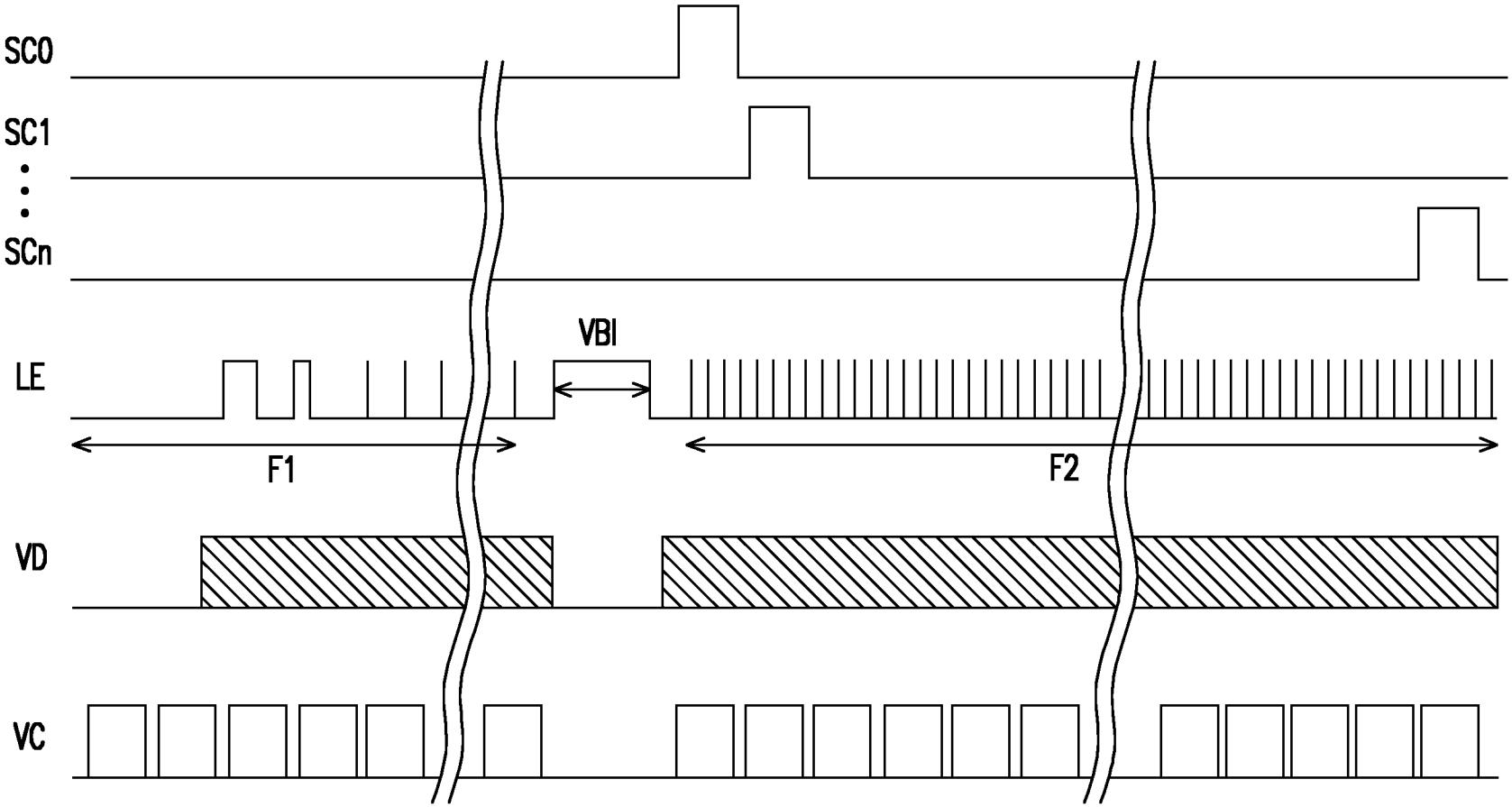
FIG. 2 is an operation waveform diagram of display by a display device according to an embodiment of the disclosure.

FIG. 2 is an operation waveform diagram of display by a display device 1*a* or 1*b* according to an embodiment of the disclosure. As shown in FIG. 2, the display device 1*b* may be operated in frame times F1 and F2, and according to scan signals SC0 to SCn and a data latch signal LE, a data signal VD may be a grayscale data provided by the controller Con to the pixel PX for display, and a control signal VC may be a signal provided by the controller Con to the sensing circuit 10 to emit light. Specifically, in the frame time F1, according to the control of the data latch signal LE and the scan signals SC0 to SCn, the pixel PX may be written with the data signal VD for display. At the same time, the controller Con may provide the control signal VC to the sensing circuit 10 to control the test pixel 100 to emit light. In a vertical blank interval VBI of the frame time F1, a pulse width adjusting signal may be provided to the controller Con to adjust the pulse width at which the pixels PX are operated for display. In an embodiment, the pulse width adjusting signal may be provided to the controller in a vertical blank interval of each frame time. In an embodiment, the pulse width adjusting signal may be provided to the controller only in a vertical blank interval of multiple frame times. For example, the sensing circuit 10 may be operated at a frequency of turning on once every four seconds, so that the pulse width adjusting signal may be provided to the controller Con at a frequency of providing once every four seconds. In other words, in an exemplary case where the display device 1*b* may display 60 frame times per second, a cycle of the pulse width adjusting signal may be 240 frame times, and the pulse width adjusting signal may be constantly provided to the controller Con in each cycle.

Figure 3:
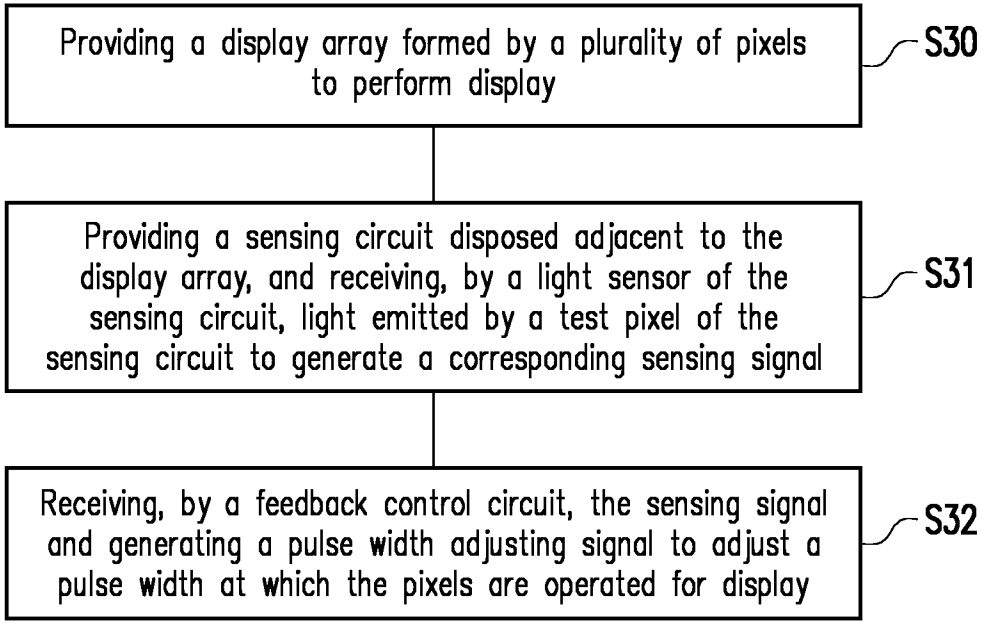
FIG. 3 is a schematic view of a display method according to an embodiment of the disclosure.

FIG. 3 is a schematic view of a display method according to an embodiment of the disclosure. The display method includes steps S30 to S32. The display method may be executed by the display device 1*a* shown in FIG. 1A or the display device 1*b* shown in FIG. 1B.

In step S30, a display array DA formed by a plurality of pixels PX may be provided to perform display. Specifically, the pixels PX in the display array DA may receive a display data and control of a driving signal to display an image.

In step S31, a sensing circuit 10 is provided, and a light sensor 101 of the sensing circuit 10 receives light emitted by a test pixel 100 of the sensing circuit 10 to generate a corresponding sensing signal. Specifically, the test pixel 100 may be disposed adjacent to the display array DA, so that the test pixel 100 has the same or similar display conditions as the pixels PX. The light sensor 101 may receive the light emitted by the test pixel 100 and generate a corresponding sensing signal according to the brightness of the received light. In an embodiment, the sensing circuit 10 may be constantly on to provide a pulse width adjusting signal in a vertical blank interval VBI of each frame time. In an embodiment, the sensing circuit 10 may be turned on periodically to provide a pulse width adjusting signal at a cycle of multiple frame times, which can save power consumption and the computing capacity of the controller Con.

In step S32, a feedback control circuit 20 receives the sensing signal and generates a pulse width adjusting signal to adjust a pulse width at which the pixels PX are operated for display. Specifically, the feedback control circuit 20 may acquire the sensing signal provided by the sensing circuit 10, which includes the brightness of the light emitted by the test pixel 100 under the current display condition. On the other hand, the feedback control circuit 20 may also acquire the control signal received by the test pixel 100, which includes a predetermined brightness that is controlled to be displayed. Alternatively, the feedback control circuit 20 may also sense a driving current driving the display array DA through an interface circuit 200. Accordingly, the feedback control circuit 20 may determine the color decay of the test pixel 100 according to the sensing signal, the control signal, and/or the driving current of the display array DA and generate a pulse width adjusting signal according to the degree of color decay to thereby adjust the pulse width at which the pixels PX are operated for display.

Therefore, through the display device 1*a* shown in FIG. 1A, the display device 1*b* shown in FIG. 1B, and/or the display method shown in FIG. 3, the color decay of the pixel PX caused by display under different display conditions can be effectively improved. In an embodiment, the display device 1*a* shown in FIG. 1A, the display device 1*b* shown in FIG. 1B, and/or the display method shown in FIG. 3 may also perform individual sensing and calibration for pixels displaying different colors, so that the differentiated color decay occurring among the pixels PX of different colors can also be effectively improved.

Figure 4A:
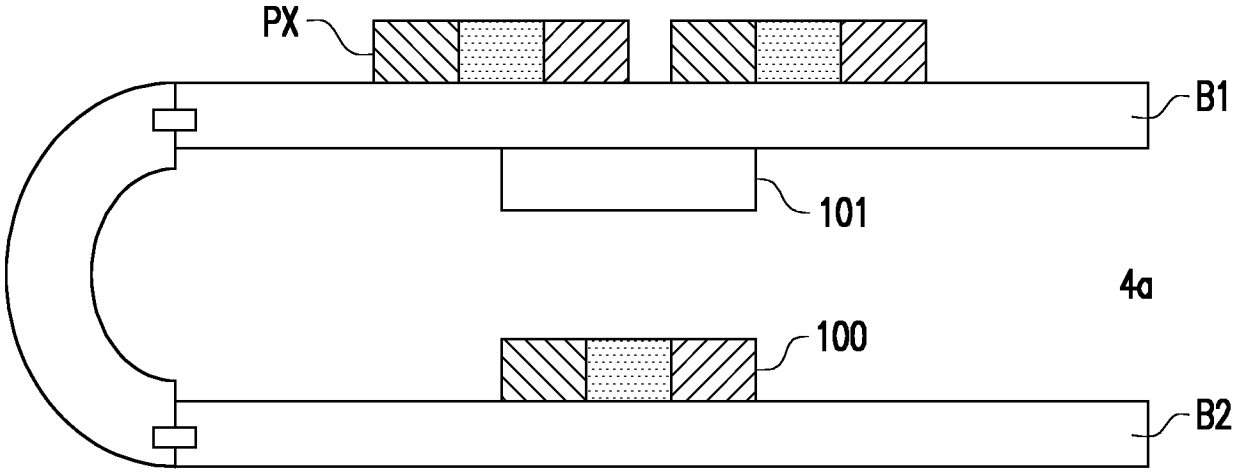
FIG. 4A is a side view of a display device according to an embodiment of the disclosure.

In addition, those with ordinary skill in the art may of course make adjustments to the display device 1*a* shown in FIG. 1A, the display device 1*b* shown in FIG. 1B, and/or the display method shown in FIG. 3. For example, referring to FIG. 4A, FIG. 4A is a side view of a display device 4*a* according to an embodiment of the disclosure. In FIG. 4A, for convenience of illustration, some components (e.g., the controller Con, the feedback control circuit 20, etc.) are omitted. Specifically, the display device in FIG. 4A includes boards B1 and B2. The boards B1 and B2 are disposed in parallel to each other, and the boards B1 and B2 may be connected to each other through a flexible cable. In this embodiment, the test pixel 100 may be disposed on the board B2, and disposed on a surface of the board B2 facing the board B1. The light sensor 101 is disposed relative to the test pixel 100, and the light sensor 101 is disposed on the board B1, on a surface opposite to the surface where the pixels PX are disposed. The light sensor 101 is disposed on a surface of the board B1 facing the board B2. Accordingly, the light sensor 101 can correspondingly receive the light emitted by the test pixel 100, which can effectively avoid the interference of stray light and effectively improve the sensing accuracy.

Figure 4B:
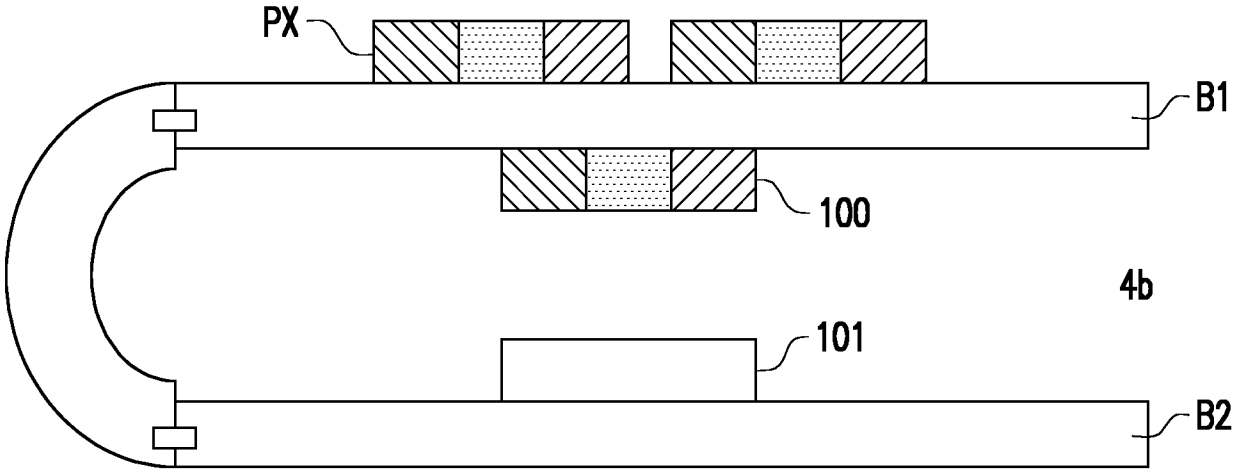
FIG. 4B is a side view of a display device according to an embodiment of the disclosure.

FIG. 4B is a side view of a display device 4*b* according to an embodiment of the disclosure. The display device 4*b* shown in FIG. 4B is similar to the display device 4*a* shown in FIG. 4A, and the difference between the two only lies in that, in the display device 4*b*, the test pixel 100 is disposed on the board B1 and the light sensor 101 is disposed on the board B2. Specifically, the test pixel 100 may be disposed on a surface of the board B1 facing the board B2, and the test pixel 100 may be disposed on the board B1, on a surface opposite to the surface where the pixels PX are disposed. The light sensor 101 is disposed relative to the test pixel 100. The light sensor 101 is disposed on a surface of the board B2 facing the board B1.

In summary of the above, in the display device and the display method of the disclosure, the current display condition of the pixels may be approximated through the sensing circuit to generate a corresponding sensing signal. According to the sensing signal, the feedback control circuit determines the degree of color decay of the pixels under the current display condition to generate a pulse width adjusting signal to adjust the pulse width at which the pixels are operated for display. In brief, the display device and the display method of the disclosure can effectively overcome the color decay occurring under different display conditions, or overcome the differentiated color decay occurring among the pixels of different colors under the same display condition. Therefore, the image quality displayed by the display device can be effectively improved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device comprising:

a first board comprising a display array formed by a plurality of pixels;

a sensing circuit comprising a test pixel and a light sensor, wherein the light sensor receives light emitted by the test pixel to generate a corresponding sensing signal; and a feedback control circuit receiving the sensing signal and generating a pulse width adjusting signal to adjust a pulse width at which the pixels are operated for display, wherein the feedback control circuit comprises:

an arithmetic circuit coupled to the sensing circuit, wherein the arithmetic circuit calculates a brightness decay value according to the sensing signal and reference brightness information;

a pulse width compensation circuit coupled to the arithmetic circuit, wherein the pulse width compensation circuit calculates the pulse width adjusting signal according to the brightness decay value;

an interface circuit coupled to the sensing circuit, wherein the interface circuit receives the sensing signal;

a filter coupled to the interface circuit, wherein the filter filters out noise in the sensing signal;

an analog-to-digital converter coupled between the filter and the arithmetic circuit, wherein the analog-to-digital converter provides the filtered sensing signal to the arithmetic circuit for calculation; and a transceiver coupled to the pulse width compensation circuit, the arithmetic circuit, and a microcontroller, wherein the transceiver provides the pulse width adjusting signal calculated by the pulse width compensation circuit to the microcontroller, and the transceiver receives the reference brightness information from the microcontroller and provides the reference brightness information to the arithmetic circuit.

2. The display device according to claim 1, wherein the light sensor receives light of a first color emitted by the test pixel to generate the corresponding sensing signal, and the feedback control circuit receives the sensing signal to accordingly adjust the pulse width at which the pixels are operated for displaying the first color.

3. The display device according to claim 1, wherein the feedback control circuit further senses a driving current configured to drive the display array to adjust the pulse width at which the pixels are operated for display.

4. The display device according to claim 1, further comprising a second board, and the second board comprises the microcontroller configured to drive the display array, wherein the sensing circuit is disposed on the first board or the second board.

5. The display device according to claim 4, wherein the feedback control circuit provides the pulse width adjusting signal to the microcontroller in a vertical blank interval in a frame time.

6. The display device according to claim 4, wherein the first board and the second board are disposed in parallel to each other, the test pixel and the light sensor of the sensing circuit are disposed on two surfaces, which face each other, of the first board and the second board, and a configuration position of the test pixel corresponds to a configuration position of the light sensor.

7. A display method comprising:

providing a display array formed by a plurality of pixels to perform display;

providing a sensing circuit, and receiving, by a light sensor of the sensing circuit, light emitted by a test pixel of the sensing circuit to generate a corresponding sensing signal; and receiving, by a feedback control circuit, the sensing signal and generating a pulse width adjusting signal to adjust a pulse width at which the pixels are operated for display, wherein the feedback control circuit comprises:

an arithmetic circuit coupled to the sensing circuit, wherein the arithmetic circuit calculates a brightness decay value according to the sensing signal and reference brightness information;

a pulse width compensation circuit coupled to the arithmetic circuit, wherein the pulse width compensation circuit calculates the pulse width adjusting signal according to the brightness decay value;

an interface circuit coupled to the sensing circuit, wherein the interface circuit receives the sensing signal;

a filter coupled to the interface circuit, wherein the filter filters out noise in the sensing signal;

an analog-to-digital converter coupled between the filter and the arithmetic circuit, wherein the analog-to-digital converter provides the filtered sensing signal to the arithmetic circuit for calculation; and a transceiver coupled to the pulse width compensation circuit, the arithmetic circuit, and a microcontroller, wherein the transceiver provides the pulse width adjusting signal calculated by the pulse width compensation circuit to the microcontroller, and the transceiver receives the reference brightness information from the microcontroller and provides the reference brightness information to the arithmetic circuit.

8. The display method according to claim 7, further comprising:

sensing, by the feedback control circuit, a driving current configured to drive the display array to adjust the pulse width at which the pixels are operated for display.

* * * * *